US005125659A

United States Patent [19]

Garbee

[11] Patent Number: 5,125,659

[45] Date of Patent: Jun. 30, 1992

[54] ROTATABLE DRUM FOR SELECTING LOTTERY NUMBERS

[76] Inventor: Leon Garbee, 171 Henry St., Greenwich, Conn. 06830

[21] Appl. No.: 711,857

[22] Filed: Jun. 7, 1991

[51] Int. Cl.[5] ..... A63F 3/06

[52] U.S. Cl. ..... 273/144 A

[58] Field of Search ..... 273/144 A, 144 R, 138 R, 273/115

[56] References Cited

U.S. PATENT DOCUMENTS

| | | | |
|---|---|---|---|
| 2,221,337 | 11/1940 | West | 273/144 A |
| 2,349,623 | 5/1944 | Hickey | 273/144 A |
| 2,731,268 | 1/1956 | Raizen | 273/144 A |
| 3,232,621 | 1/1966 | Michelson | 273/144 A |
| 3,901,510 | 8/1975 | Demaio | 273/115 |
| 4,999,001 | 3/1991 | Johnson | 273/144 A |

FOREIGN PATENT DOCUMENTS

| | | | |
|---|---|---|---|
| 422705 | 1/1935 | United Kingdom | 273/144 A |

*Primary Examiner*—Benjamin Layno

*Attorney, Agent, or Firm*—Alfred E. Miller

[57] ABSTRACT

A lottery number selection device having a rotatable drum with offset or staggered slots around the periphery. The drum contains an amount of numbered chips or discs corresponding the total amount of numbers in a lottery, the chips being agitated by rotating the drum and passing individually out of the sized slots until six or more numbers for the lottery picks are selected.

5 Claims, 2 Drawing Sheets

FIG.1
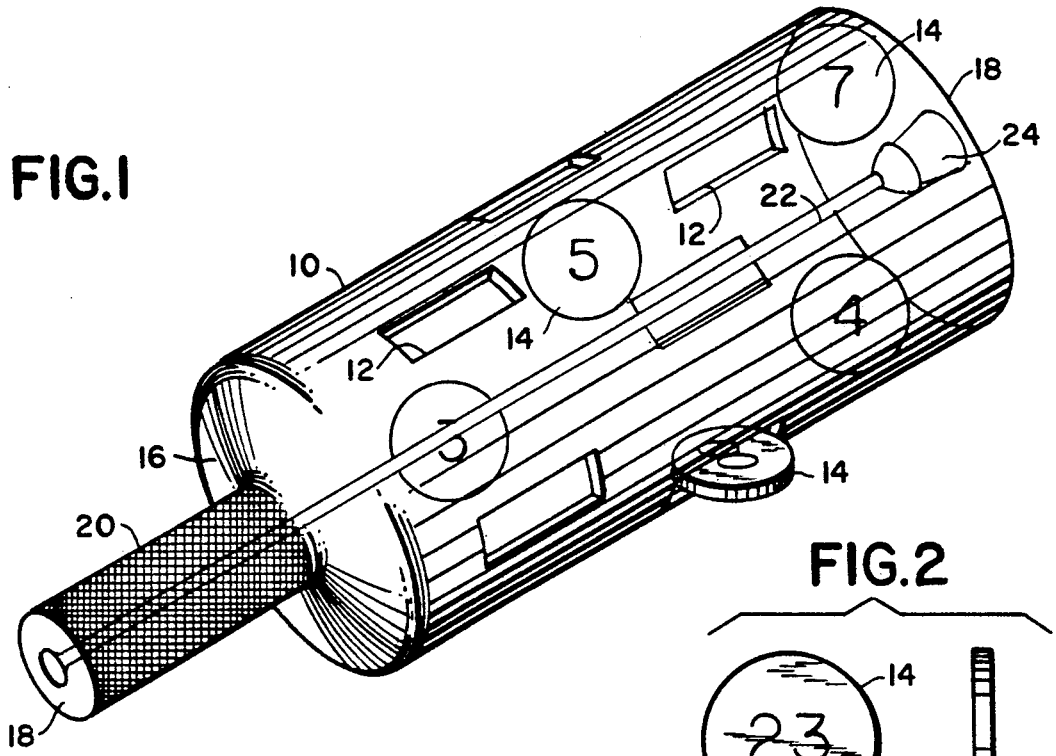
FIG.2
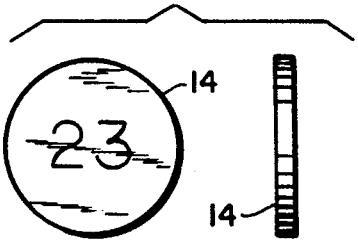
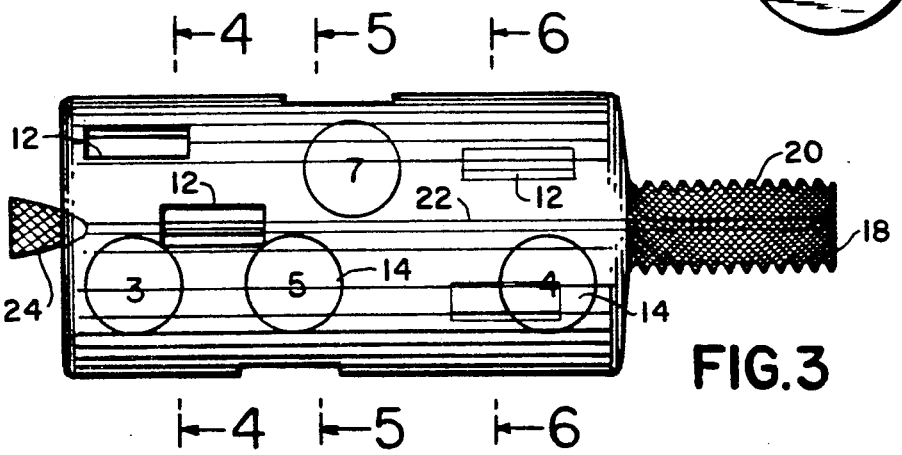
FIG.3
FIG.4
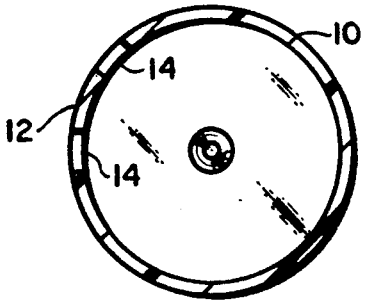
FIG.5
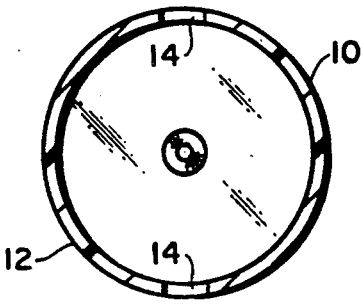
FIG.6
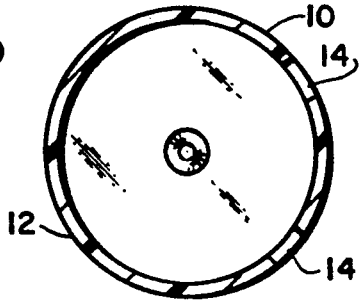

ROTATABLE DRUM FOR SELECTING LOTTERY NUMBERS

The present invention relates to a cylindrical drum which can be hand-held and portable, or crank-operated for selecting lottery numbers.

Heretofore lottery players selected numbers either at random, or by means of a special progression, such as numerical dates for a person's birthday, marriage or other special events. Obviously, other schemes for allegedly selecting "winning" numbers have also been devised. However, there is a constant search by lottery players to improve the odds of receiving "winning" numbers.

BACKGROUND OF THE INVENTION

A plurality of discs each having a circular configuration and having a relatively small height are placed in a drum for rotation so that discs can be thoroughly mixed. The discs may be numbered poker chips, and the drum is further provided with a series of offset slots around the periphery thereof, so that when the drum is rotated, the various discs are agitated to a point where they constantly move around the inner surface of the drum until they are aligned with a particular slot and they drop out individually from the drum by gravity. This procedure is repeated until the required number of discs or chips are dropped out of the slots in the cylindrical drum to correspond with the number of lottery numbers to be selected. Six or more numbered discs or chips are to be selected for the lotteries presently being held in the various states of the United States.

It is an object of the present invention to provide a portable, rotatable drum for selecting lottery numbers from a group of numbered chips which is inexpensive to manufacture, and can be made small enough to be easily carried by the user to any location.

A further object of the present invention is to provide a rotatable drum for selecting lottery numbers which is mounted on a stand for use on a table, or the like, and is provided with a hand crank for rotating the drum thereby selecting the numbered discs which fall by gravity through staggered slots along the periphery of the drum.

It is a further object of the present invention to provide offset slots in a rotatable drum for selecting lottery numbers on numbered discs in which the slots are sized to permit only a single disc to pass therethrough at any given time.

Another object of the present invention is to provide an opaque rotatable drum with offset slots that can be inexpensively fabricated and is reliably effective for the purposes intended.

In order that the present invention will be more clearly understood, it will now be disclosed in greater detail with reference to the accompanying drawings in which the description of the drawings.

DESCRIPTION OF THE DRAWINGS

FIG. 1 is a perspective view of a hand-held cylindrical rotatable drum for selecting lottery numbers constructed in accordance with the teachings of my invention.

FIG. 2 is both the front and side elevation of a numbered disc or chip utilized with my rotatable drum.

FIG. 3 is a side elevational view showing the handle on one side of the cylindrical drum and a finger hold on the opposite side of the drum.

FIG. 4 is a sectional view taken along the lines 4—4 of FIG. 3.

FIG. 5 is a sectional view taken along the lines of 5—5 of FIG. 3.

FIG. 6 is a sectional view taken along the lines 6—6 of FIG. 3, and;

DESCRIPTION OF THE PREFERRED EMBODIMENTS

Figure 7:
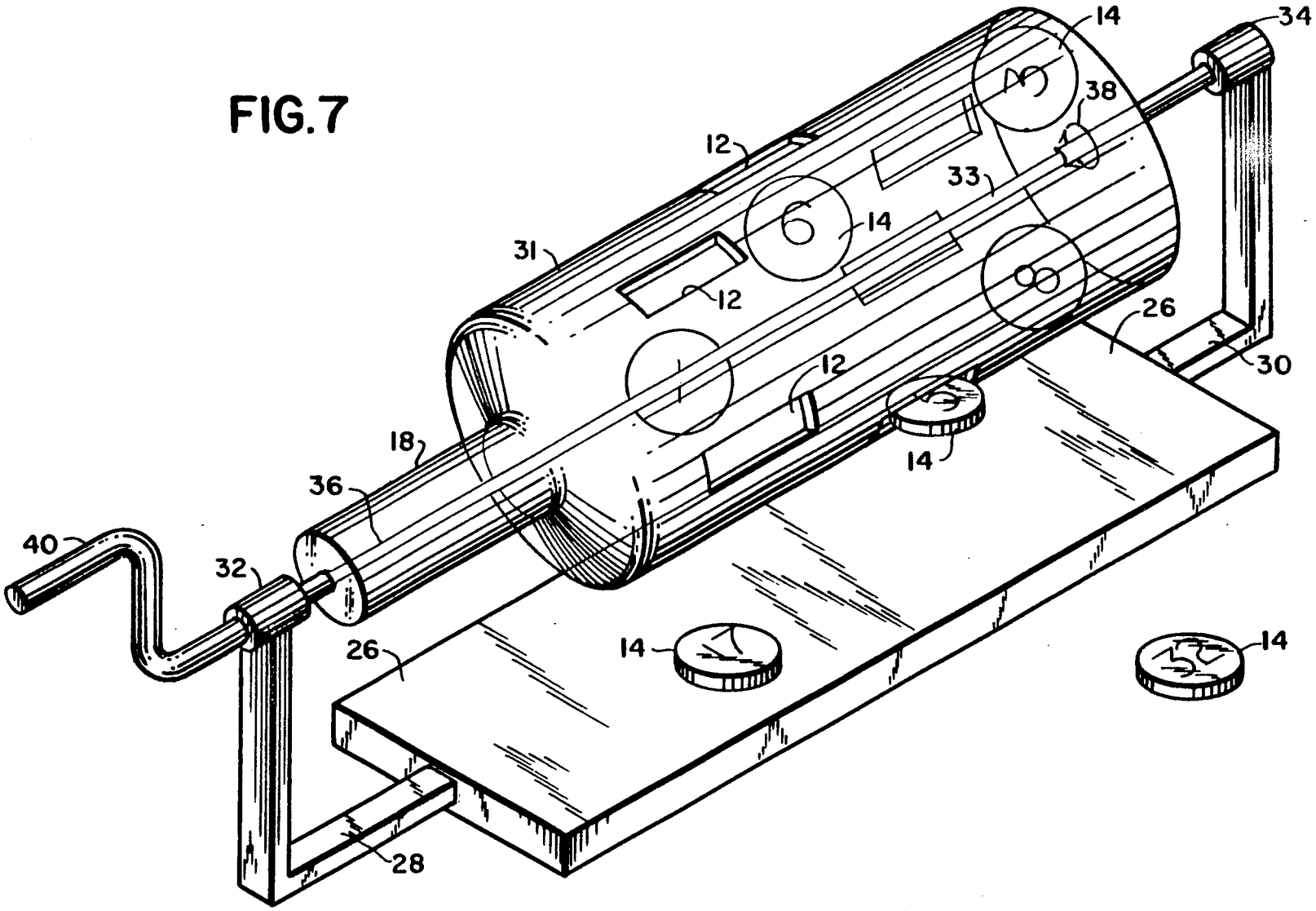
FIG. 7 is a alternate embodiment of the present invention showing a crank operated cylindrical drum for selecting lottery numbers and provided with a stand to make it self supporting.

Referring particularly to FIGS. 1–6 a hand-held portable lottery drum 10 is shown. It should be apparent that although the drum 10 is illustrated in cylindrical form it may take other forms, such as a rectangular box or an elliptical enclosure. The drum 10 is provided with a plurality of slots 12 which are offset or staggered relative to each other. It is important that the drum be provided with at least six slots about its entire periphery. Within the drum 10 are a multiplicity of chips, or discs 14, in the order of 60 or more, all of which are numbered.

It has been found that the lottery drum works best when the dimensions are approximately 8" in length and 4" in diameter with a 3" neck portion functioning as a handle. Each of the slots are preferable $1\frac{1}{2}$" long and a $\frac{1}{4}$" wide so that they pass only one numbered disc or chip at any given time through the slot. Moreover, the slots are spaced $1\frac{3}{4}$" apart. Furthermore, the entire drum is fabricated of a opaque material such as a colored plastic, so that the discs cannot be viewed while rotating the drum. The end 16 of the drum 10 is provided with a neck portion 18 having an knurled surface 20, functioning as a handle. The handle 20 has an internal rod 22 which passes centrally through the rotatable drum 10 and is affixed to the opposite end 19 of the drum. As clearly seen in FIG. 3, the opposite end 19 of the drum is provided with a projecting hand-hold 24, so that the drum can be rotated easily while holding the handle 20 in one hand and holding the hand-hold 24 with several fingers of the other hand, thus permitting the drum to be spun in the hands of a user in order to thoroughly mix and agitate the discs while causing the numbered discs to be ejected from the drum 10 individually through the offset slots 12.

As is seen in FIGS. 4, 5 and 6 the slots 12 are offset or staggered relative to each other so that none of the slots are precisely lined up with each other whereby the entire inner surface of the drum is provided with slots to capture the discs 14 which are agitated upon rotating the drum 10.

Although six offset slots about the circumference of the drum are shown in the drawings it is within the scope of the present invention to provide additional slots in some states in the United States use more than sixty numbers in their lottery. Consequently, more slots are appropriate with a larger number of numbered discs or chips are utilized in the drum. In that case it may be necessary to enlarge the drum so that additional slots are also offset relative to the other slots in the periphery of the drum. In addition, it should be noted that the discs may be in the form of standard poker chips having numbers applied or can be specially manufactured discs having the numbers based thereon. Since the slots 12 are such a dimension that only one disc will pass therethrough at a time the drum is rotated and agitated continually until the selected number of discs are individually dispensed through the various slots in the lottery drum.

Referring now to an alternate embodiment of the present invention is shown in FIG. 7. A base 26 is provided having an L shaped bracket 28 at one end and another L shaped bracket 30 at the other end. The bracket 28 is provided with a bearing sleeve 32 while the bracket 30 is provided with an end bearing 34, a crank 36 passes through the bearing 32 and crank shaft 33 passes centrally through an aperture 29 in the neck portion 18 of the drum 31 and out an aperture 38 in the end 19 of the drum with the extreme end being held in the bearing 34. The crank is operated by a crank handle 40. Thus, by rotating the crank handle 40 the drum 31 can be variously agitated so that the discs 14 therein will find their way through the various slots 14 until the required number of discs have been injected, thus representing the selected numbers for the lottery. The structure shown in FIG. 7 is intended to be rather in the nature of a device that is supported on a table or bureau rather than being portable, as is the lottery device shown in FIGS. 1–6.

Although the present invention has been disclosed and described with reference to two embodiments thereof, it should be apparent that other variations and modifications may be made, and it is intended that the following claims cover each said variations and modifications as follows within the true spirit and scope of the invention.

I claim:

1. A hand held cylindrical rotatable drum for selecting lottery numbers having a multiplicity of numbered discs inside the drum and being provided with a plurality of through slots which are staggered and nonaligned on the periphery of said drum, said drum having a neck portion projecting from one end wall which functions as a handle for rotating said drum, a finger hold projecting from the other end wall of said drum in order to mix said numbered discs, and each of said slots having dimensions whereby one disc will pass therethrough at a time until the selected number of discs fall outside the drum.

2. A rotatable drum as claimed in claim 1 wherein said handle is knurled for securely grasping said handle.

3. A rotatable drum as claimed in claim 1 further being provided with an internal rod passing substantially centrally through said drum and connecting said handle to said finger hold.

4. A rotatable drum as claimed in claim 1 wherein said drum is opaque and cylindrical.

5. A rotatable drum as claimed in claim 1 wherein said through slots are staggered in the periphery of said drum, and at least six numbered discs are selected as lottery picks.

* * * * *